US009563150B2

(12) United States Patent
Takahashi et al.

(10) Patent No.: US 9,563,150 B2
(45) Date of Patent: Feb. 7, 2017

(54) DEVELOPING DEVICE

(71) Applicant: CANON KABUSHIKI KAISHA, Tokyo (JP)

(72) Inventors: Kyosuke Takahashi, Toride (JP); Atsushi Matsumoto, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/381,716

(22) PCT Filed: Apr. 26, 2013

(86) PCT No.: PCT/JP2013/062879
§ 371 (c)(1),
(2) Date: Aug. 28, 2014

(87) PCT Pub. No.: WO2013/162075
PCT Pub. Date: Oct. 31, 2013

(65) Prior Publication Data

US 2015/0071683 A1 Mar. 12, 2015

(30) Foreign Application Priority Data

Apr. 27, 2012 (JP) ..... 2012-102951

(51) Int. Cl.
*G03G 15/08* (2006.01)
*G03G 15/09* (2006.01)

(52) U.S. Cl.
CPC ..... *G03G 15/0891* (2013.01); *G03G 15/0893* (2013.01); *G03G 15/0907* (2013.01); *G03G 15/0921* (2013.01); *G03G 2215/0822* (2013.01)

(58) Field of Classification Search
CPC ..... G03G 15/0891; G03G 15/0893; G03G 15/0907;G03G 15/0921; G03G 2215/083; G03G 2215/0833; G03G 2215/0822
See application file for complete search history.

(56) References Cited

U.S. PATENT DOCUMENTS 5,682,583 A * 10/1997 Ito et al. ..... 399/254
5,963,766 A 10/1999 Okuno et al.
(Continued)

FOREIGN PATENT DOCUMENTS

JP H04-125661 A 4/1992
JP H06-051634 A 2/1994
(Continued)

OTHER PUBLICATIONS

Machine translation of JP2007271863.*
(Continued)

*Primary Examiner* — David Bolduc
(74) *Attorney, Agent, or Firm* — Fitzpatrick, Cella, Harper & Scinto

(57) ABSTRACT

A developing device includes a developer carrying member, a first chamber for feeding developer to the developer carrying member, a second chamber for collecting developer from the developer carrying member, and a feeding member provided rotatably in the first chamber for feeding the developer. The feeding member includes a rotation shaft and a spiral blade wound helically in a developer feeding direction. The feeding member includes a first region corresponding to a developer coating region of the developer carrying member, a second region provided downstream of the first region with respect to a feeding direction of the feeding member, and a third region provided upstream of the first region. An average feeding power per unit driving time of the feeding member is set at a smaller value in the first region than in the second region and in the third region.

8 Claims, 6 Drawing Sheets

(56) References Cited

U.S. PATENT DOCUMENTS

| | | | | |
|---|---|---|---|---|
| 6,360,066 | B1 * | 3/2002 | Kawahito et al. | 399/254 |
| 8,548,361 | B2 | 10/2013 | Noguchi et al. | |
| 8,731,443 | B2 * | 5/2014 | Mihara et al. | 399/254 |
| 2004/0179865 | A1 * | 9/2004 | Nishiyama | 399/254 |
| 2005/0281588 | A1 * | 12/2005 | Okuda et al. | 399/254 |
| 2006/0245792 | A1 * | 11/2006 | Tatsumi et al. | 399/254 |
| 2007/0134025 | A1 | 6/2007 | Bessho | |
| 2007/0231015 | A1 * | 10/2007 | Sakamaki | 399/257 |
| 2008/0181672 | A1 * | 7/2008 | Hatakeyama et al. | 399/254 |
| 2011/0318062 | A1 | 12/2011 | Hayashi | |
| 2012/0201574 | A1 * | 8/2012 | Hayashi et al. | 399/258 |
| 2012/0251185 | A1 | 10/2012 | Matsumoto | |
| 2012/0269555 | A1 | 10/2012 | Matsumoto et al. | |

FOREIGN PATENT DOCUMENTS

| | | | |
|---|---|---|---|
| JP | 07-244426 | A | 9/1995 |
| JP | H08-220887 | A | 8/1996 |
| JP | 10-123811 | A | 5/1998 |
| JP | 3127594 | B2 | 1/2001 |
| JP | 2002-006599 | A | 1/2002 |
| JP | 2004-151276 | A | 5/2004 |
| JP | 2004-151354 | A | 5/2004 |
| JP | 2005-215483 | A | 8/2005 |
| JP | 2007-271863 | A | 10/2007 |
| JP | 2007-310098 | A | 11/2007 |
| JP | 2010-038939 | A | 2/2010 |
| JP | 2010-197839 | A | 9/2010 |
| JP | 2011-028216 | A | 2/2011 |
| JP | 2011-059605 | A | 3/2011 |
| JP | 2012-042738 | A | 3/2012 |

OTHER PUBLICATIONS

Notification of Transmittal of the International Search Report and The Written Opinion of the International Searching Authority, mailed Aug. 6, 2013.

European Search Report dated Nov. 19, 2015, in related European Patent Application No. 13781888.6.

Korean Official Action dated Dec. 11, 2015, in related Korean Patent Application No. 10-2014-7032465.

Masanori Akita et al., U.S. Appl. No. 14/376,952, filed Aug. 6, 2014.

* cited by examiner

DEVELOPING DEVICE

TECHNICAL FIELD

The present invention relates to a developing device for developing an electrostatic latent image, into a toner image with a two-component developer, formed on a latent image bearing member (photosensitive member, dielectric member or the like) by an electrophotographic system, an electrostatic recording system or the like.

BACKGROUND ART

An electrophotographic apparatus of a transfer type will be described as an example. In the electrophotographic apparatus in which a toner is electrically charged to form an image by using an electrostatic force, the charged toner is supplied from the developing device to the electrostatic latent image formed on the photosensitive member as the latent image bearing member so that the electrostatic latent image is visualized (developed) as the toner image. The toner image is transferred onto a recording material (paper or the like) and is fixed as a fixed image on the recording material under heat and pressure by a fixing device, and then the recording material is outputted as an image-formed product.

A density of the image to be outputted is determined by a toner amount per unit area on the recording material and a toner characteristic after the fixing. The present invention relates to the developing device for supplying the toner in a desired amount to the electrostatic latent image and therefore the amount of the toner used for development will be briefly described below. In the case where the electrostatic latent image is the same, the amount of the toner used for development is smaller with a higher charge amount of the toner, and on the other hand, is larger with a lower charge amount of the toner. Thus, the density of the output image is changed depending on the toner charge amount and therefore in order to output the image with a stable density, there is a need to properly keep the toner charge amount.

In the electrophotography, the toner is controlled by using the electrostatic force even in other steps, and therefore it is important to keep the toner charge amount at a desired value. However, the present invention relates to the developing device and therefore in the following, the developing device will be principally described.

The developing device includes, in an ordinary case, a developing container in which a screw for circulating the developer therein while stirring and feeding the developer is incorporated, and includes a developer carrying member, which opposes the latent image bearing member, for conveying the developer toward the latent image bearing member. Further, in the ordinary case, in order that the amount of the developer which is carried on the developer carrying member and which is conveyed toward the neighborhood of the latent image bearing member is made a desired value, a developer regulating member for regulating a gap (spacing) between the developing container and the developer carrying member is provided in the developing container side.

In the present invention, as the developer, the two-component developer comprising a non-magnetic toner and a magnetic carrier is used. The two-component developer may contain no magnetic material in the toner and, therefore for the reason that a color (tint) is good or the like reason, the two-component developer has been widely used in a color image forming apparatus.

In the case of the developing device using the two-component developer, in general, as the developer carrying member, a developing sleeve in which a magnet roller (magnetic field generating means) having a developer carrying ability is incorporated is used. The developing sleeve carries the developer by a magnetic force of the magnet roller and is rotated to convey the developer to the latent image bearing member, thus supplying the toner to the electrostatic latent image. The toner is electrically charged by friction with the carrier and therefore the toner charge amount is different depending on a ratio between the toner and the carrier. The toner and the carrier in the developer are charged to opposite polarities and the sum of the charge amounts is zero, and therefore the toner charge amount becomes smaller with a higher toner ratio in the developer.

That is, even with respect to the same electrostatic latent image, the toner charge amount is changed by a change in toner ratio and therefore the amount of the toner used for development is different. For this reason, in the ordinary case, the toner in substantially the same amount as that of the toner consumed by image formation is supplied so as to control the toner charge amount at a substantially constant level, so that the ratio between the toner and the carrier is used within a certain range. When the toner ratio of the developer is excessively high, the toner charge amount becomes low, so that a problem such as toner scattering is generated. On the other hand, when the toner ratio of the developer is excessively low, the carrier is deposited to disturb the toner image developed from the electrostatic latent image or electric charges flow from the carrier to the latent image bearing member to disturb the electrostatic latent image.

Further, even when the toner ratio in the developing device is roughly a desired value, in the case where there is a local non-uniformity of the toner ratio of the developer supplied to the electrostatic latent image bearing member, non-uniformity in amount of the toner used for development is generated depending on the non-uniformity of the toner ratio. Therefore, it is desirable that the ratio of the toner, before the development, conveyed on the developer carrying member is constant to the possible extent.

In order to solve such a problem, as in Japanese Patent No. 3127594, a developing device constitution such that the toner ratio of the developer supplied to the latent image bearing member is constant has been proposed.

In order to explain the developing device constitution in Japanese Patent No. 3127594, from the viewpoint such that the toner ratio of the developer on the developer carrying member is made constant to the possible extent, the constitution of the two-component developing device is roughly classified into a conventional type developing device and a new type developing device. These two constitutions are different in positional relation between a developer circulation path and the developer carrying member.

In general, in the developing device, the developer carrying member for conveying the developer toward the latent image bearing member and the developing container in which a feeding screw for circulating the developer in the developing container is incorporated are provided. When the developing container is considered in a function-separation manner, the developing container includes a developer feeding chamber for feeding the developer to the developer carrying member and a collecting chamber for collecting, in the developing container, the developer lowered in toner ratio by conveying the developer to an opposing portion in the neighborhood of the latent image bearing member by the developer carrying member to develop the electrostatic latent image into the toner image. Further, the developing container includes a developer stirring chamber for stirring a supply toner in an amount depending on the amount of the collected developer and the amount of the toner used for development to make the toner ratio in the developing container substantially constant.

Further, the developing container includes a first connecting portion for connecting a downstream portion of the developer stirring chamber with respect to a developer conveying (feeding) direction and an upstream portion of the developer feeding chamber with respect to the developer conveying direction. Further, the developing container includes a second connecting portion for connecting a downstream portion of the developer feeding chamber with respect to the developer carrying direction and an upstream portion of the developer stirring chamber with respect to the developer conveying direction. Further, the developing container includes a supplying portion for supplying the toner depending on the amount of the consumed toner. In general, in order to make the toner ratio in the developer feeding chamber substantially constant, a toner supplying opening is provided in the neighborhood of the second connecting portion between the downstream portion of the developer feeding chamber with respect to the developer conveying direction and the upstream portion of the developer stirring chamber with respect to the developer conveying direction.

In the conventional type developing device, the developer is fed to the developer carrying member from the developer feeding chamber having a feeding function and a collecting function, and the developer used for development is collected. For this reason, the developer used for development and lowered in toner ratio is included in the developer stirring chamber, and therefore the local non-uniformity of the toner ratio is liable to occur. Further, the toner ratio is more lowered with a position close to a downstream end of the developer feeding chamber.

On the other hand, in the new type developing device, the feeding function and the collecting function are independent of each other. For this reason, when the toner ratio of the developer entering the developer feeding chamber is constant, the toner ratio is constant in the entire region of the developer feeding chamber.

However, in the above-described developing device constitution (the new type developing device), the developer is not collected in the developer feeding chamber and therefore there is a tendency that the amount of the developer in the developer feeding chamber is not readily maintained. When the developer amount in the developer feeding chamber is insufficient, the developer cannot be fed onto the developer carrying member and therefore there arises a problem such that a part of the electrostatic latent image for an image cannot be developed.

SUMMARY OF INVENTION

The present invention is further development of the above-described developing device. A principal object of the present invention is to provide a developing device, including a developing container having a constitution in which a feeding function and a collecting function are independent of each other, capable of suppressing a necessary developer amount while maintaining an amount of a developer in a developer feeding chamber.

Accordingly, an aspect of the present invention is to provide a developing device comprising: a developer carrying member for carrying a developer comprising a non-magnetic toner and a magnetic carrier to develop a latent image; a first chamber, provided at a position where the first chamber opposes the developer carrying member, in which the developer is fed to the developer carrying member; a second chamber, provided at a position where the second chamber opposes the developer carrying member, in which the developer is collected from the developer carrying member; a partition wall for partitioning the first chamber and the second chamber; a communicating portion, provided at each of end portions of the partition wall, for forming a circulation path by the first chamber and the second chamber; and a feeding member, provided rotatably in the first chamber, for feeding the developer in the first chamber, wherein in the circulation path, the feeding member includes a first region corresponding to a developer coating region of the developer carrying member and a second region, provided downstream of the first region with respect to a feeding direction of the feeding member, corresponding to a region outside the developer coating region of the developer carrying member, and wherein feeding power per unit driving time of the feeding member is set at a smaller value in the first region than in the second region.

These and other objects, features and advantages of the present invention will become more apparent upon a consideration of the following description of the preferred embodiments of the present invention taken in conjunction with the accompanying drawings.

Figure 8:
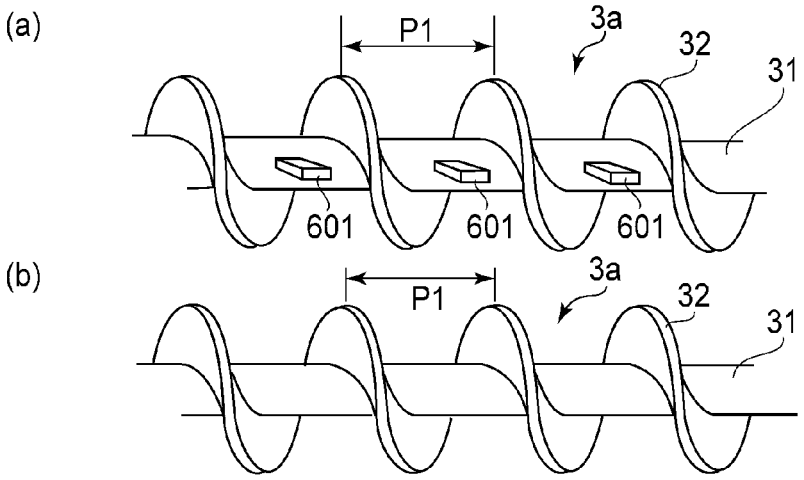

Part (a) of FIG. 8 is a schematic view of a characteristic feeding screw used in Embodiment 1, and (b) of FIG. 8 is a schematic view of a conventional feeding screw.

Figure 9:
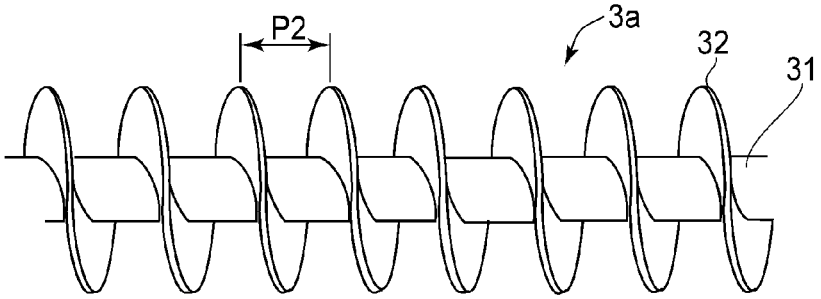
Figure 10:
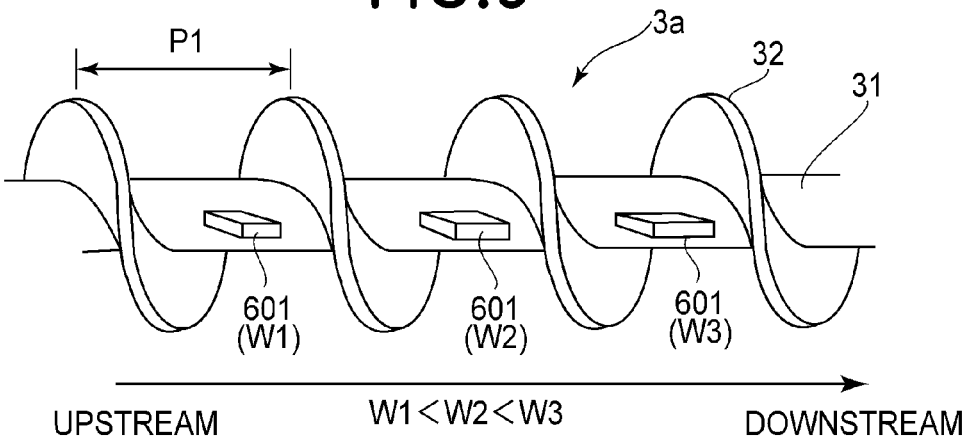

FIGS. 9 and 10 are schematic views of characteristic feeding screws used in Embodiments 2 and 3, respectively.

Figure 11:
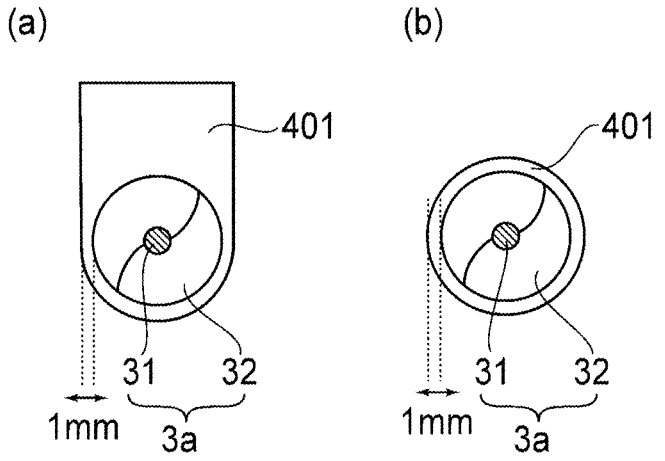

Part (a) of FIG. 11 is a schematic sectional view of a developer feeding chamber in an upstream side in Embodiment 4, and (b) of FIG. 11 is a schematic view of the developer feeding chamber in a downstream side in Embodiment 4.

Figure 12:
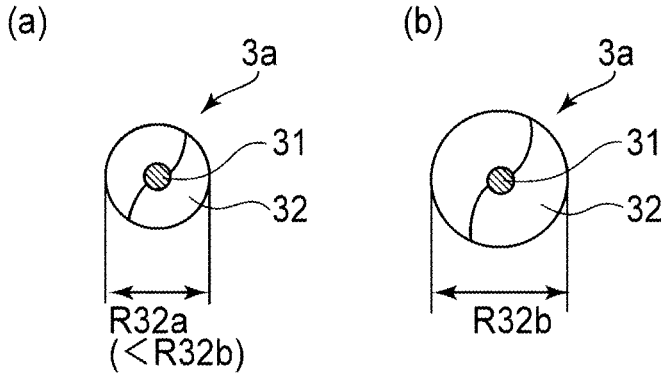

Parts (a) and (b) of FIG. 12 are schematic views each showing a characteristic feeding screw used in Embodiment 5.

Figure 13:
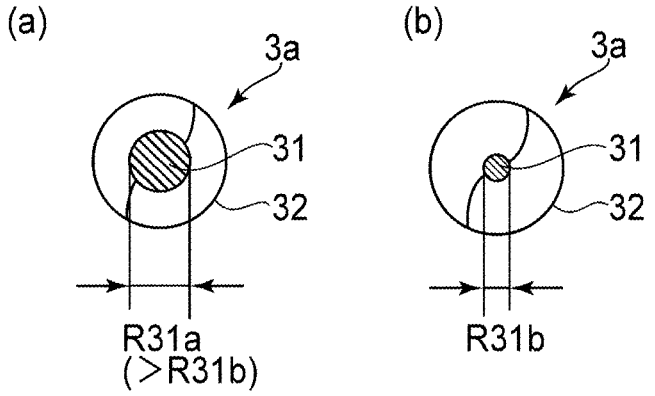

Parts (a) and (b) of FIG. 13 are schematic views each showing a characteristic feeding screw used in Embodiment 6.

DESCRIPTION OF EMBODIMENTS

Embodiments of the present invention will be specifically described below.

Embodiment 1

Figure 1:
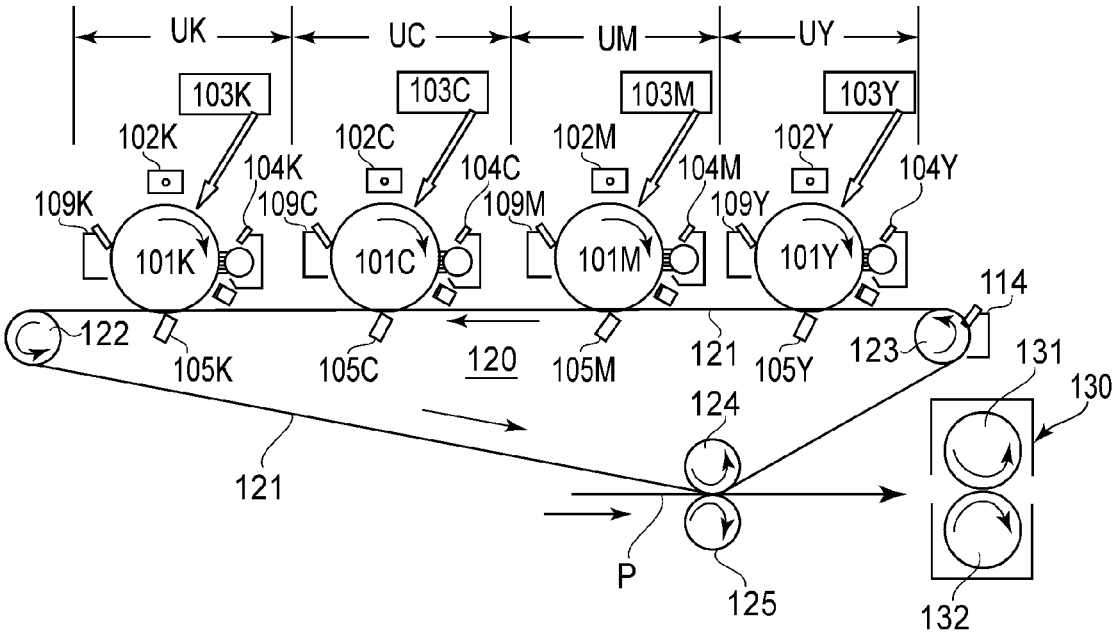
FIG. 1 is a schematic view of an image forming apparatus in Embodiment 1.

Image Forming Apparatus to which Developing Device of the Present Invention is Applicable FIG. 1 is a schematic structural view of a principal part of an image forming apparatus in this embodiment. This image forming apparatus is a four color-based full-color electrophotographic apparatus of an in-line type and an intermediary transfer type. Inside the electrophotographic apparatus, first to fourth (four) image forming stations U (UK, UM, UC, UK) are juxtaposed in the horizontal direction from left to right on the drawing sheet of FIG. 1. The image forming stations (portions) are electrophotographic image forming mechanisms having the same constitution except that only colors of toners of two-components developers accommodated in developing devices are yellow (Y), magenta (M), cyan (C) and black (K), respectively, which are different from one another.

That is, each image forming station U includes an electrophotographic photosensitive member 101 (Y, M, C, K) as a latent image bearing member (electrostatic latent image bearing member) (hereinafter referred to as a drum). Further, as process means actable on the drum 101, a primary charging device 102 (Y, M, C, K), a laser exposure device 103 (Y, M, C, K) and a developing device 104 (Y, M, C, K) are provided. In this embodiment, the primary charging device 102 is device of a corona charging type which is a non-contact charging type. Further, a primary transfer blade 105 (Y, M, C, K) and a drum cleaner 109 (Y, M, C, K) are provided.

The drum 101 of each image forming station is rotationally driven in the clockwise direction indicated by an arrow at a predetermined speed. Then, on the drum 101Y of the first image forming station UY, a Y (color) toner image corresponding to a Y (color) component image for a full-color image to be formed is formed. On the drum 101M of the second image forming station UM, an M toner image corresponding to an M component image is formed.

Further, on the drum 101C of the third image forming station C, a C toner image corresponding to a C component image is formed. On the drum 101K of the fourth image forming station K, a K toner image corresponding to a K component image is formed. With respect to the drum 101 of each image forming station U, electrophotographic image forming process and principle of the toner image are well known and therefore will be omitted from description.

In a downstream side of each image forming station U, a flexible and endless intermediary transfer belt 121 as an intermediary transfer member is provided. The belt 121 is extended and stretched around three rollers consisting of a driving roller 122, a tension roller 123 and a secondary transfer opposite roller 124. The belt 121 is moved and circulated in the counterclockwise direction indicated by an arrow at a speed corresponding to a rotational speed of the drum 101 by driving the driving roller 122.

Toward the secondary transfer opposite roller 124, a secondary transfer roller 125 is contacted to the belt 121 at predetermined pressure (urging force). A contact portion between the belt 121 and the secondary transfer roller 125 is a secondary transfer nip.

The primary transfer blade 105 of each image forming station U is provided inside the belt 121 and is contacted to the belt 121 toward a lower surface of the drum 101. A contact portion between the drum 101 and the belt 121 at each image forming station U is a primary transfer nip. To the primary transfer blade 105, a predetermined primary transfer bias is applied at predetermined control timing.

Images of the Y toner, the M toner, the C toner and the K toner formed on the drums 101 of the image forming stations U, respectively, are successively primary-transferred superposedly onto the surface of the belt 121 which is moved and circulated. As a result, on the belt 121, an unfixed full-color toner image by the superposed toners of the four colors of Y, M, C and K is synthetically formed on the belt 121, and then is conveyed to the secondary transfer nip.

On the other hand, a recording material (sheet) P is fed from a sheet feeding mechanism portion (not shown) and is introduced into the secondary transfer nip, thus being nipped and conveyed at the secondary transfer nip. To the secondary transfer roller 125, a predetermined secondary transfer bias is applied. As a result, the full-color toner image is successively secondary-transferred collectively from the belt 121 onto the recording material P.

Then, the recording material P coming out of the secondary transfer nip is separated from the surface of the belt 121 and then is introduced into a fixing device 130. The recording material P is nipped and conveyed by a fixing roller pair 131 and 132 to be heated and pressed. As a result, the unfixed toner image is fixed as a fixed image on the recording material surface. The recording material P coming out of the fixing device 130 is discharged as a color image-formed product.

The toner remaining on the surface of the drum 101 after the primary transfer of the toner image onto the belt 121 at each image forming station U is removed from the drum surface by the drum cleaner 109, so that the drum 101 is repetitively subjected to image formation. Further, the toner remaining on the surface of the belt 121 after the secondary transfer of the toner image onto the recording material P is removed from the belt surface by a belt cleaner 114, so that the belt 121 is repetitively subjected to image formation.

Incidentally, in the image forming apparatus in this embodiment, a drum-shaped photosensitive member is used as the latent image bearing member but it is also possible to use a belt-shaped photosensitive member. Further, also with respect to the charging type, the transfer type, the cleaning type and the fixing type, these types are not limited to those described above. The present invention relates to the developing device and the same embodiment can be applied to the respective image forming stations U, and therefore in the following, one image forming station will be noted and described.

<Developing Device>

Figure 2:
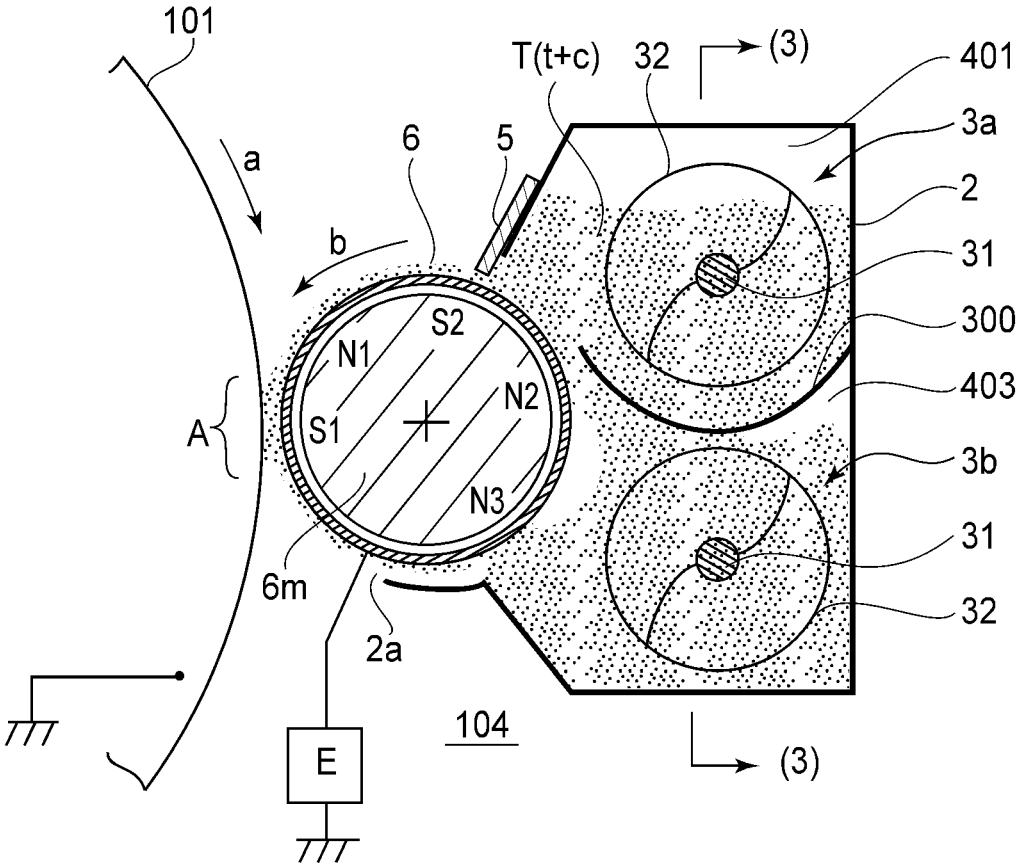
FIG. 2 is a schematic cross-sectional view of a developing device.
Figure 3:
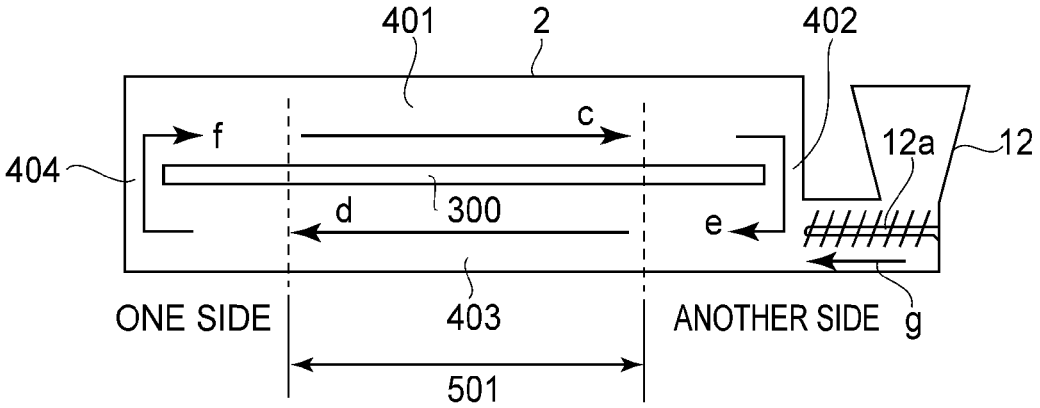
FIG. 3 is a schematic view of the developing device taken along (3)-(3) line indicated in FIG. 2.

FIG. 2 is a schematic cross-sectional view of the developing device 104, and FIG. 3 is a schematic sectional vie of the developing device taken along (3)-(3) line indicated in FIG. 2. The developing device 104 is a device for developing the latent image into the toner image by applying, to the drum (latent image bearing member) 101 on which the latent image is formed, a two-component developer T including a non-magnetic toner t and a magnetic carrier c, and is a device extending in a longitudinal direction which is a direction parallel to a rotational axis (shaft) direction of the drum 101.

The developing device 104 includes an elongated developing container 2 for accommodating a developer T and a developer carrying member 6 for applying (supplying) the developer T to the drum 101 opposing thereto while carrying the developer T. The developer carrying member 6 is provided rotatably at an opening 2*a* provided at the developer carrying member 6. A rotation axis (shaft) of the developer carrying member 6 is substantially parallel to that of the drum 101.

In this embodiment, as the developer carrying member 6, a developing sleeve 6 in which a magnet roller 6*m* as a magnetic field generating means is incorporated was used. The developing sleeve carries the developer T by a magnetic force of the incorporated magnet roller 6*m* and conveys the developer T in a developer conveyance direction by being rotated, thus supplying the developer T to the electrostatic latent image formed on the surface of the drum 101 at a developing region A where the developing sleeve 6 opposes the drum 101.

The inside of the developing container 2 is partitioned via a partition wall 300 into a developer feeding chamber (developing chamber) 401 as a first developer accommodating chamber in an upper side and a developer stirring chamber 403 as a second developer accommodating chamber in a lower side which chambers are provided vertically in parallel to each other. The developer feeding chamber 401 is a functional chamber for feeding (supplying) the developer to the developer carrying member 6. The developer stirring chamber 403 is a functional chamber for stirring the developer after receiving the developer T collected from the developing sleeve 6 and a supplied developer for supply.

In one end side of the developer feeding chamber 401 and the developer stirring chamber 403 with respect to the axial direction of the developing sleeve 6, a first connecting portion 404 for communicating the developer feeding chamber 401 and the developer stirring chamber 403 with each other is provided. Further, in another end side of the developer feeding chamber 401 and the developer stirring chamber 403 with respect to the axial direction of the developing sleeve 6, a second connecting portion 402 for communicating the developer feeding chamber 401 and the developer stirring chamber 403 with each other is provided.

Further, in the developer feeding chamber 401 and the developer stirring chamber 403, a first feeding screw 3*a* as a first developer feeding member and a second feeding screw 3*b* as a second developer feeding member are provided, respectively. In FIG. 3, the first feeding screw 3*a* and the second feeding screw 3*b* are omitted from illustration.

The first feeding screw 3*a* and the second feeding screw 3*b* circulates the developer T in a developer circulation path constituted by the first connecting portion 404, the developer feeding chamber 401, the second connecting portion 402 and the developer stirring chamber 403 while feeding the developer T in the developer feeding chamber 401 and the developer stirring chamber 403. That is, the developing container 2 has a functional constitution for circulating the developer T in the developer circulation path therein while stirring and feeding the developer T. Further, in this embodiment, in another end side of the developer stirring chamber 403, a developer supplying portion 12 for supplying the supply developer to the developer stirring chamber 403 is provided.

<Developer>

The toner t and the carrier c of the two-component developer used in this embodiment will be described. The toner t contains a binder resin, a colorant and, as desired, an additive such as silica. The binder resin for the toner t is, e.g., a negatively chargeable polyester resin and may preferably have a volume-average particle size of 4 μm or more and 10 μm or less. In this embodiment, the toner t having the volume-average particle size of 7 μm was used.

When the particle size of the toner t is excessively small, it becomes difficult to produce friction with the carrier c and therefore the charge amount of the toner t is not readily controlled, and when the particle size of the toner t is excessively large, a definite toner image cannot be formed. Further, with respect to the toner in recent years, in many cases, a toner having a low melting point or a toner having a low glass transition point Tg (e.g., Tg≤70° C.) is used for improving a fixing property. In some cases, in order to improve a separating property after the fixing, a wax is contained in the toner.

As the carrier c, surface-oxidized or un-oxidized metals such as iron, nickel, cobalt, manganese, chromium, rare earth, and their alloys or oxides, such as ferrite are suitably usable, and a manufacturing method of these magnetic particles is not particularly limited. The carrier c may preferably have the volume-average particle size of 20-60 μm, and in this embodiment, the carrier having the volume-average particle size of 40 μm was used. When the particle size of the carrier c is excessively small, there arises a problem that the carrier c is deposited on the drum 101 during development, and when the particle size of the carrier c is excessively large, there arises a problem that the carrier c disturbs the toner image during development.

<Cross-Section of Developing Device>

In the developing device 104 in this embodiment, the developing container 2 is provided with the opening 2*a* at a position corresponding to the developing region A where the developing sleeve 6 opposes the drum 101, and at the opening 2*a*, the developing sleeve 6 is provided rotatably so as to be partly exposed toward the drum 101. The magnet roller 6*m* incorporated in the developing sleeve 6 is fixed in a non-rotational manner. The developing sleeve 6 faces the developer feeding chamber 401 and the developer stirring chamber 403 in its developing container side.

A flow of the developer T in a cross-section of the developing device 104 shown in FIG. 2 will be described. First, in the developer feeding chamber 401, the developer T is raised with developer feeding by the first feeding screw 3*a*, so that the developer is fed (supplied) to the developing sleeve 6. In the developer T, the magnetic carrier c is mixed and therefore the developer in the neighborhood of the developing sleeve 6 is constrained by the magnetic force generated by the magnet roller 6*m*, so that the developer T is carried as a developer layer on the surface of the developing sleeve 6.

Then, the developer on the developing sleeve 6 passes through a gap portion between the developing sleeve 6 and a regulating member (developer thickness regulating member) 5 fixedly provided at its end on the developing container 2 while being opposed to the developing sleeve 6 with a predetermined gap. As a result, an amount of the developer on the developing sleeve 6 is regulated at a predetermined proper amount. In this embodiment, the developer amount is regulated at a proper amount per unit area of 30 mg/cm$^2$. The developer subjected to the amount regulation is conveyed by further rotation of the developing sleeve 6 to the developing region A where the developing sleeve 6 opposes the drum 101, and then is applied (supplied) to the drum 101. As a result, the latent image on the drum 101 is developed as the toner image with the toner t of the developer T.

The developer T passing through the developing region A is returned into the developing container 2 by further rotation of the developing sleeve 6 and is conveyed, so that the developer T is separated from the developing sleeve 6 by a separation magnetic field by repelling magnetic poles N3 and N2 of the magnet roller 6*m*, thus being collected by the second feeding screw 3*b* in the developer stirring chamber 403.

<Developing Sleeve>

A surface property and developer conveying property of the developing sleeve 6 will be described. First, in the case where the surface of the developing sleeve 6 is smooth such as a specular (mirror) surface, a degree of the friction between the developer T and the developing sleeve 6 is extremely small and therefore the developer is little conveyed. Therefore, proper projections and recesses are formed on the surface of the developing sleeve 6, and by the projections and recesses, the friction between the developer and the developing sleeve 6 is intentionally produced to ensure a conveyance amount of the developer. Such a constitution is used in general. In this embodiment, as a method of forming the proper projections and recesses at the surface of the developing sleeve 6, blasting was used.

The blasting is a processing method in which particles, such as abrasive powder or glass beads, having a predetermined particle size distribution are blasted at high pressure. In the following, a portion where the blasting is effected is referred to as a blasted region, and a portion where the blasting is not effected is referred to as a non-blasted region. On the developing sleeve 6, the blasted region with developer conveying power is located in a range somewhat under than an image formable region, and the non-blasted region with no developer conveying power is located at each of end portions. In FIG. 3, although the developing sleeve 6 is not illustrated, a reference numeral 501 represents the blasted region, of the developing sleeve 6, with the developer conveying power (hereinafter, referred to as a developer carrying region of the developing sleeve 6).

<Magnet Roller>

The magnet roller 6*m* will be described with reference to FIG. 2. The magnet roller 6*m* incorporated as the roller-shaped magnetic field generating means in the developing sleeve 6 is disposed fixedly and non-rotationally in the developing container 2. The magnet roller 6*m* has a developing magnetic pole S1 at an opposing position to the developing region A. By a magnetic field of the S1 pole formed in the developing region A, the developer T forms an erected magnetic brush. The magnetic brush selectively deposits the charged toner t on the electrostatic latent image by an electrostatic force while being contacted to the drum 101 rotated in the clockwise direction indicated by an arrow a, thus developing the electrostatic latent image as the toner image in the developing region A.

The magnet roller 6*m* has, in addition to the developing magnetic pole S1, magnetic poles N1, N2, N3 and S2, i.e., 5 magnetic poles in total. A function of each magnetic pole of the magnet roller 6*m* and a flow of the developer in cross-section will be described.

First, with the developer conveyance of the first feeding screw 3*a* in the developer feeding chamber 401, the developer T is raised and thus is supplied to the developing sleeve 6. In the developer T, the magnetic carrier is mixed and therefore is constrained by the N2 pole.

Then, with rotation of the developing sleeve 6, the developer T passes through the S2 pole opposing the regulating member 5 and is regulated at a proper amount. The developer T subjected to the amount regulation passes through the N1 pole to reach the S1 pole opposing the drum 101. The developer T passing through the developing region A to consume the toner t for developing the electrostatic latent image is returned into the developing container 2 and then is conveyed. Then, between the N3 and N2 poles as the repelling magnetic poles, the developer T is released from a magnetic confining force by the magnetic poles to be liberated from the developing sleeve 6, thus being collected by the second feeding screw 3*b* in the developer stirring chamber 403.

<Regulating Member>

The regulating member 5 is, in order to provide a proper amount of the developer T carried on the developing sleeve 6 to be supplied to the electrostatic latent image, disposed opposed to the developing sleeve 6 in an upstream side of the developing region A with respect to a rotational direction of the developing sleeve 6. Thus, the regulating member 5 defines a gap in which the developer T on the developing sleeve 6 can pass from the developing container 2 toward the developing region A.

In this embodiment, as the regulating member 5, a plate-like regulating blade extended along the axial direction of the developing sleeve 6 was used. As a material for the regulating blade 5, it is possible to use a non-magnetic material such as aluminum or stainless steel, a magnetic low-carbon steel material such as SPCC, or a laminate member of the non-magnetic material and the magnetic material. Further, the regulating blade 5 is provided in the developing container 2 side at a position upstream of the drum 101 with respect to the developing sleeve rotational direction so that a blade end is directed toward the center of the developing sleeve 6.

By the rotation of the developing sleeve 6, the developer T on the developing sleeve 5 passes between the end of the regulating blade 5 and the developing sleeve 6 to be sent to the developing region A. Accordingly, by adjusting the gap between the regulating blade 5 and the surface of the developing sleeve 6, the amount of the developer to be carried on the developing sleeve 6 and conveyed to the developing region A is adjusted.

Incidentally, when the gap between the regulating blade 5 and the developing sleeve 6 is excessively narrow, a foreign matter in the developer or an aggregate of the toner is liable to clog, thus being unpreferable. Further, when the weight (amount) per unit area of the developer conveyed on the developing sleeve 6 is excessively large, there arises a problem such that the developer clogs in the neighborhood of the opposing position to the drum 101 or that the carrier is deposited on the electrostatic latent image bearing member. When the amount is excessively small, there arises a problem that a desired toner image cannot be formed by development to lower an image density. In this embodiment, the gap between the regulating blade 5 and the developing sleeve 6 was set at 400 μm so as to provide the developer amount (per unit area) of 30 mg/cm$^2$.

<Developing Region>

In this embodiment, the developing sleeve 6 is 20 mm in diameter, and the drum 101 is 80 mm in diameter. Further, the closest region between the developing sleeve 6 and the drum 101 was set at 400 μm. By this constitution, in a state in which the developer conveyed to the developing region A is contacted to the drum 101, setting is made so that the development can be effected. Incidentally, the developing sleeve 6 is constituted by non-magnetic aluminum, and inside the developing sleeve 6, the magnet roller 6*m* as the magnetic field generating means is provided in a non-rotational state. In the developing region A, the developer forms the magnetic brush by the magnetic field of the S1 pole located at the opposing position to the drum 101 in the developing region A.

In the above constitution, the developing sleeve 6 is rotated during development in the counterclockwise direction indicated by an arrow b as shown in FIG. 2, thus conveying the developer, regulated in a proper amount by the regulating blade 5, to the developing region A where the developing sleeve 6 opposes the drum 101. In the developing region A, the developer T forms the magnetic brush by the magnetic field of the magnet roller 6*m* to supply the toner to the electrostatic latent image formed on the drum 101, so that the toner image is obtained.

In this case, to the developing sleeve 6, a developing bias voltage in the form of a DC voltage biased with an AC voltages is applied from a developing bias power source E. In this embodiment, the developing bias including the DC voltage of −500 V and the AC voltage of a rectangular wave and of 1800 V in peak-to-peak voltage Vpp and 12 kHz in frequency f was used. However, the DC voltage volume and AC voltage waveform are not limited to those described above.

Further, in the developing region A, the developing sleeve 6 moves (rotates) in the same direction b as a movement direction (rotational direction) a of the drum 101 and moves at a peripheral speed ratio to the drum of 2.0. The peripheral speed ratio is set in general between 1.0 and 3.0. With respect to the peripheral speed ratio, a larger value provides a better developing property but when the value is excessively large, there arise problems such as toner scattering and developer deterioration. Therefore, the peripheral speed ratio may preferably be set in the above-described range.

<Longitudinal Structure of Developing Device>

A longitudinal structure of the developing device 104 will be described with reference to FIGS. 2 and 3. The inside of the developing container 2 is partitioned via the partition wall 300 into the upper-side developer feeding chamber 401 and the lower-side developer stirring chamber 403 which are provided in parallel and vertically with respect to the direction of gravitation, and the developer T is accommodated in the developer feeding chamber 401 and the developer stirring chamber 403.

In the developer feeding chamber 401 and the developer stirring chamber 403, as the developer stirring and feeding means, the first feeding screw 3*a* and the second feeding screw 3*b* which are the feeding member are disposed, respectively. The first feeding screw 3*a* is disposed at a bottom of the developer feeding chamber 401 along the axial direction of the developing sleeve 6, and is rotated to supply the developer T to the developing sleeve 6 while feeding the developer in an axial direction c in the developer feeding chamber 401. Further, the second feeding screw 3*b* is disposed at a bottom of the developer stirring chamber 403 along the axial direction of the developing sleeve 6, and conveys the developer T, in the developer stirring chamber 403, in an axial direction d opposite to the axial direction c of the first feeding screw 3*a*.

The developer feeding chamber 401 and the developer stirring chamber 403 communicate with each other in another end side with respect to the axial direction of the developing sleeve 6. That is, these chambers communicate with each other at a lowering portion (second connecting portion) 402 where the developer passing through the developer feeding chamber 401 without being supplied from the developer feeding chamber 401 to the developing sleeve 6 is lowered to the developer stirring chamber 403.

Further, the developer feeding chamber 401 and the developer stirring chamber 403 communicate with each other in one end side with respect to the axial direction of the developing sleeve 6. That is, these chambers communicate with each other at a raising portion (first connecting portion) 404 where the developer collected from the developing sleeve 6 in the developer stirring chamber 403 and the developer lowered from the developer feeding chamber 401 are raised to the developer feeding chamber 401.

By the feeding of the developer by rotation of the first feeding screw 3*a* and the second feeding screw 3*b*, the developer T is circulated between the developer feeding chamber 401 and the developer stirring chamber 403 through the raising portion 404 and the lowering portion 402 which are communicating portions located at longitudinal end portions of the partition wall 300. An arrow f represents a direction in which the developer T is fed from the developer stirring chamber 403 to the developer feeding chamber 401 through the raising portion 404, and an arrow e represents a direction in which the developer T is fed from the developer feeding chamber 401 to the developer stirring chamber 403 through the lowering portion 402.

In this embodiment, the developer feeding chamber 401 and the developer stirring chamber 403 are vertically disposed with respect to the direction of gravitation. However, the present invention is also applicable to a developing device in which the developer feeding chamber 401 and the developer stirring chamber 403 are horizontally disposed as frequently used in a conventional constitution or a developing device in another form.

<Developing Feeding Path>

As a path along which the developer is stirred and fed, there are two paths including a first path which is a circulation path contributing to the development and a second path which is another circulation path, which does not contribute to the developer, in the developing container 2. The first path is a path along which the developer passes in the order of the developer feeding chamber 401, the developing sleeve 6, the developer stirring chamber 403, the raising portion 404 and the developer feeding chamber 401. The second path is a path along which the developer passes in the order of the developer feeding chamber 401, the lowering portion 402, the developer stirring chamber 403, the raising portion 404 and the developer feeding chamber 401.

<Developer Supplying Method>

A developer supplying method in this embodiment will be described with reference to FIG. 3. In another end side of the developer stirring chamber 403, a developer supplying portion 12 for supplying (replenishing) the supply developer to the developer stirring chamber 403 is provided. In this embodiment, the developer supplying portion 12 is illustrated as a hopper for accommodating the supply developer containing the toner and the carrier.

The hopper 12 includes a screw-shaped supply developer feeding member 12*a* at its lower portion, and an end of the supply developer feeding member 12*a* is extended to a position of a supply opening 11 provided in another end side of the developer stirring chamber 403. A controller (not shown) controls the supply developer feeding member 12*a* to feed, from the hopper 12, the supply developer containing a toner substantially in the same amount as a consumed amount by image formation, thus supplying the supply developer to the developer stirring chamber 403 through the supply opening 11.

That is, the supply developer is fed from the hopper 12 in a direction indicated by an arrow g to enter the developer stirring chamber 403. The supply opening 11 is provided downstream of the developer feeding chamber 401. This is because the supplied developer is prevented from being supplied to the developing sleeve 6 before being stirred.

<Problem of Conventional Constitution>

The developing device 104 having the above-described constitution has the function of suppressing non-uniformity of the toner ratio of the developer conveyed by the developing sleeve 6 to be supplied to the drum 101. However, the developer on the developing sleeve 6 is not collected in the developer feeding chamber 401 and therefore there is a tendency that the developer amount in the developer feeding chamber 401 is not readily maintained. When the developer amount in the developer feeding chamber 401 is insufficient to the extent such that the developer cannot be supplied to a part of the developing sleeve 6, there arises a problem that a part of the image cannot be formed by developing the electrostatic latent image.

This problem is conspicuous in the constitution, as described in this embodiment, in which the developer feeding chamber 401 and the developer stirring chamber 403 are vertically disposed. Here, in the following description, "upstream" and "downstream" are those with respect to the developer feeding direction. In general, the developer flowing into the upstream portion of the developer feeding chamber 401 is fed by pushing-up of the developer at the first connecting portion 404 by the developer in the downstream side of the developer stirring chamber 403.

In the case of the developer circulation path in the constitution in this embodiment, a self-weight with respect to a direction opposite to that of the feeding path of the image connecting portion 404 is exerted on the developer, at the first connecting portion 404, to be fed to the upstream side of the developer feeding chamber 401. For that reason, in order that the downstream-side developer in the developer stirring chamber 403 pushes up the developer at the first connecting portion 404, there is a need to apply a force in excess compared with the case of the developing device in which the developer feeding chamber 401 and the developer stirring chamber 403 are disposed side by side (in the horizontal direction). As a result, a developer clogging state is creased at the first connecting portion 404 and in the downstream side of the developer stirring chamber 403, so that the developer is liable to be excessive in the developer stirring chamber 403 and is liable to be insufficient in the developer feeding chamber 401.

Figure 4:
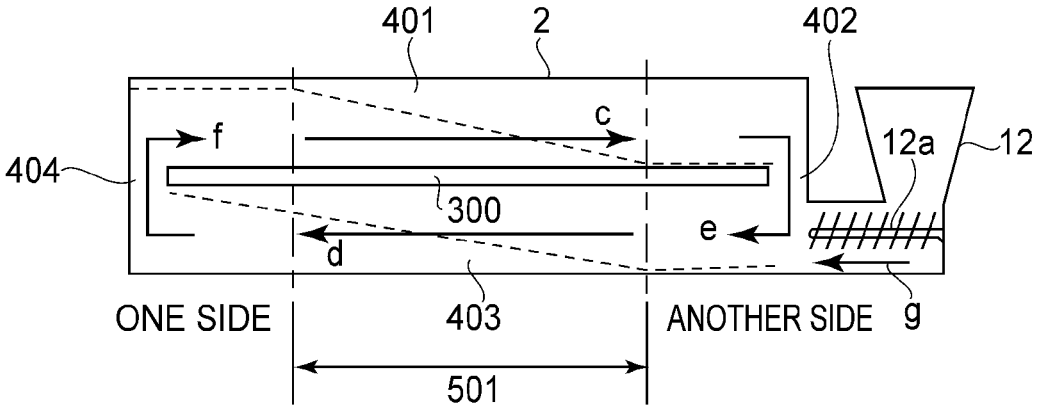
FIG. 4 is a schematic view for illustrating a distribution of a developer in the developing device with respect to a longitudinal direction before the present invention is applied.

With reference to FIG. 4, a developer distribution in the developing container 2 will be described. In FIG. 4, a broken line represents the developer surface (level) in each of the developer feeding chamber 401 and the developer stirring chamber 403. As described above, the self-weight is exerted on the developer at the first connecting portion 404 in the direction opposite to the feeding direction f and therefore the developer is in a clogged state from the downstream side of the developer stirring chamber 403 to the upstream side of the developer feeding chamber 401.

The developer T pushed up from the first connecting portion 404 flows into the upstream side of the developer feeding chamber 401 in a collapsed manner. In the developer feeding chamber 401, the developer T is fed to the downstream side while being supplied to the developing sleeve 6 and therefore the developer T is gradually decreased with a position closer to the downstream end, so that the developer surface is also gradually lowered with the position closer to the downstream end. The developer passing through the developer feeding chamber 401 is fed to the developer stirring chamber 403 via the second connecting portion 402. In the developer stirring chamber 403, the developer is fed while being collected from the developing sleeve 6, and therefore the developer is gradually increased with a position closer to the downstream end, so that the developer surface is also gradually raised with the position closer to the downstream end.

Such a distribution of the developer varies depending on various factors. In this embodiment, factors such as inclination, operation environment, image outputting operation and the like of a main assembly of the image forming apparatus will be described. When the main assembly of the image forming apparatus is inclined, the influence of the self-weight exerted on the developer along the feeding path in the developing device 104 and therefore the developer distribution is changed. Particularly, in the case where in the constitution in this embodiment, the image forming apparatus main assembly is disposed with the inclination such that the first connecting portion 404 is lower than the second connecting portion 402, the developer is in an excessive state in the downstream side of the developer stirring chamber 403 and in the upstream side of the developer feeding chamber 401. For that reason, in the downstream side of the developer feeding chamber 401, the developer cannot be supplied to the developer carrying member 6, so that image defect can occur.

In general, when the operation environment is changed, the charge amount of the toner t and carrier c of the developer T is changed. This would be considered because a chargeable amount of the carrier c is changed. In the ordinary case, under a high-temperature and high-humidity environment, the chargeable amount of the carrier c is changed. With this change, density of the developer T becomes high.

In the constitution in this embodiment, when the density of the developer T becomes high, a total of the self-weight exerted on the whole developer at the first connecting portion 404 is increased, so that the pushing-up force of the developer toward the developer feeding chamber 401 is further needed and therefore such a situation that the developer is insufficient in the developer feeding chamber 401 is created. Accordingly, in the case where the image forming apparatus is used in the high-temperature and high-humidity environment, the image defect is liable to occur.

In the case where the image formation is continuously effected, drive of the first feeding screw 3*a*, the second feeding screw 3*b* and the developing sleeve 6 is stabilized, so that the developer distribution settles in an equilibrium state in both of the developer circulation path and the developer feeding path. Conversely, when driving speeds of the first feeding screw 3*a*, the second feeding screw 3*b* and the developing sleeve 6 are changed, the equilibrium state is not created.

Accordingly, at the first and last stages of the image formation in which the driving speeds of the image feeding screw 3*a*, the second feeding screw 3*b* and the developing sleeve 6 are changed, the equilibrium state is not created. For this reason, when the image formation of several sheets is intermittently effected, a state in which the developer distribution is not stabilized becomes long in time relatively.

With stop of the drive of the first feeding screw 3*a* and the second feeding screw 3*b* at the time of an end of the image formation, the pushing-up force of the developer at the first connecting portion 404 toward the developer feeding chamber 401 is weakened and therefore a situation such that the developer is excessive in the developer stirring chamber 403 and is insufficient in the developer feeding chamber 401 is created. For this reason, in the case where the image formation of several sheets is effected intermittently, the image defect is liable to occur.

In the present invention, a developing device which stably maintains the developer located in the developer feeding chamber 401 and which suppresses the image defect such that a part of the image is lost is proposed.

<Characteristic Constitution of the Present Invention>

A characteristic constitution of the present invention will be described. An object of the present invention is, in the developing device 104 including the developing container 2 having a constitution in which the feeding (supplying) function and the collecting function are independent of each other, to suppress a necessary developer amount while maintaining the developer amount in the developer feeding chamber 401.

For that purpose, in the developer circulation path constituted by the first connecting portion 404, the developer feeding chamber 401, the second connecting portion 402 and the developer stirring chamber 403, a developer feeding amount is controlled as follows.

That is, an average developer feeding amount (feeding power) per unit time and unit volume of the developer in the feeding direction by the first feeding screw 3*a* at a position opposing a region (developer coating region) in which the developing sleeve 6 has the developer carrying power is made smaller than that at a portion, of the first feeding screw 3*a*, other than the position. That is, in the developer feeding chamber 401, the average developer feeding amount per unit time and unit volume by the portion of the first feeding screw 3*a* disposed at the position opposing a developer carrying region 501 of the developing sleeve 6 is made smaller than that in another region in the developer circulation path. Here, the feeding power is, in the case where the feeding member is the screw, proportional to a volume of a space, corresponding to a screw pitch, moving per unit drive time of the screw. In the case where the screw diameter is the same, there is a tendency that the feeding power becomes higher in the case of a large pitch than in the case of a small pitch. Further, in the case where the pitch (interval) is the same, there is a tendency that the feeding power becomes larger with a larger blade diameter.

As a result, the developer in the region where the first feeding screw 3*a* in the developer feeding chamber 401 opposes the developer carrying region 501 of the developing sleeve 6 is increased in amount relative to another region in the developer circulation path. By the constitution in this embodiment, the feeding amount of the developer in the feeding direction at the portion, in the developer feeding chamber 401, opposing the developer carrying region 501 of the developing sleeve 6 is lowered, so that the developer surface (level) becomes high relative to another portion. A developer surface state in the developer feeding chamber 401 in this case was shown in FIG. 5 by a broken line. Compared with FIG. 4 showing a state before the constitution in this embodiment is applied, the developer surface in the developer feeding chamber 401 is in a high state.

By the constitution, the developer in the developer feeding chamber 401 is stably maintained and is stably supplied to the developing sleeve 6, so that the image defect due to improper developer conveyance by the developing sleeve 6 can be suppressed.

In the conventional developing device constitution, i.e., in the constitution in which the developer contributing to the development is collected in the developer feeding chamber 401, a tendency that the toner ratio is lowered with a position closer to the downstream end of the feeding path becomes conspicuous. That is, when the developer feeding amount by the developer feeding member at the position opposing the developer carrying region of the developing sleeve is lowered, the developer collected in the developer stirring chamber remains in the neighborhood of the position opposing the developer carrying region of the developer carrying member. For that reason, in the developer feeding path, a change in toner ratio of the developer is liable to occur.

Further, the developer lowered in toner ratio immediately after being collected is liable to be supplied to the developing sleeve before being uniformly mixed with the developer in the developer feeding chamber and therefore (image) density non-uniformity caused due to the toner ratio non-uniformity is liable to occur.

On the other hand, in the new-type developing device, the developer feeding function and the developer collecting function are independent of each other. For that reason, when the toner ratio of the developer T entering the developer feeding chamber 401 is constant, the toner ratio is constant in the entire region of the developer feeding chamber, so that the toner ratio non-uniformity is not generated irrespective of the constitution of the developer feeding member in the developer feeding chamber. For that reason, the constitution of the present invention is capable of having an advantageous function.

<Characteristic Constitution in this Embodiment>

A characteristic constitution in this embodiment will be described with reference to FIG. 8. In this embodiment, as the first and second developer feeding members 3*a* and 3*b*, the feeding screw including a rotation shaft 31 substantially in parallel to the axis of the developing sleeve 6 and a stirring blade (screw blade) 32 formed on the outer peripheral surface of the rotation shaft 31 and helically wound in the developer feeding direction is used. P1 is a helical pitch of the stirring blade 32.

With respect to the first feeding screw 32*a* in the developer feeding chamber 401, in the developer circulation path described above, as shown in (a) of FIG. 8, a rib member 601 by which the developer is moved in a direction perpendicular to the feeding direction is provided at a position opposing the developer carrying region 501 of the developing sleeve 6. On the other hand, in the developer circulation path, the rib member 601 is not provided in a region, of the first feeding screw 3*a*, other than the position. In (b) of FIG. 8, the conventional feeding screw on which the rib member 601 is not provided.

By rotation of the first feeding screw 3*a*, the developer in the developer feeding chamber 401 is fed in a downstream side in the developer feeding direction, but at the portion of the rib member 601, the developer is pushed in a direction perpendicular to the developer feeding direction. For that reason, the feeding amount of the developer in the feeding direction becomes small relative to that at another portion (where the rib member 601 is not provided).

Figure 5:
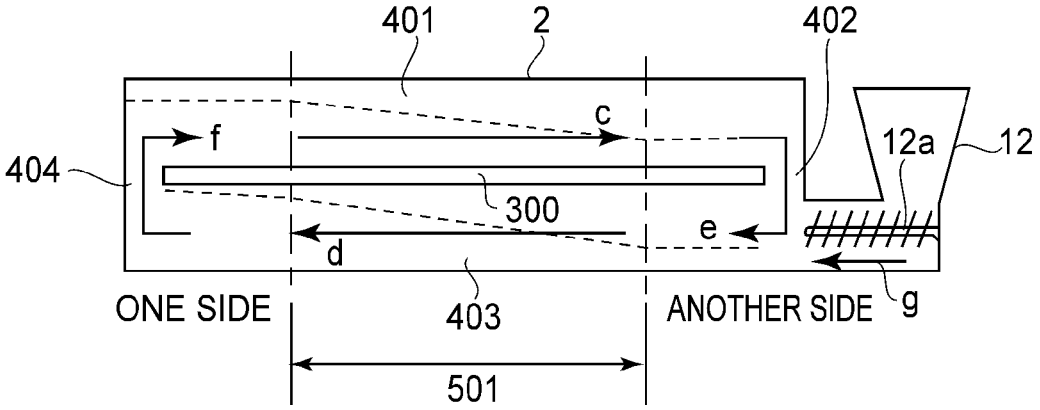
FIGS. 5 and 6 are schematic views showing developer distributions in developing devices in Embodiments 1 and 3, respectively, with respect to the longitudinal direction.

As a result, in the developer feeding chamber 401, the developer in the region opposing the developer carrying region 501 of the developing sleeve 6 is increased in amount relative to that in another region, so that the developer in the developer feeding chamber 401 can be stably maintained. The result is schematically illustrated as shown in FIG. 5, in which the developer surface (broken line) in the region, in the developer feeding chamber 401, opposing the developer carrying region 501 of the developing sleeve 6 is higher than the developer surface (broken line) shown in FIG. 4.

By the constitution in this embodiment, the developer surface in the developer feeding chamber 401 is raised, so that an amount of the developer necessary to effect the image formation is decreased. In this embodiment, the amount of the developer necessary to effect the image formation was set at an amount of the developer required to be always carried by the developing sleeve 6 in a state in which the developing device 104 is continuously driven. Here, the reason why the developer amount is discriminated in the state in which the developing device 104 is continuously driven is that the developer distribution is stabilized as described above in the case where the developing device 104 is continuously driven.

Specifically, in the case of the conventional screw constitution ((b) of FIG. 8 in which the helical pitch and the number of rotations are the same as those in (a) of FIG. 8), the necessary developer amount is 300 g, but in the constitution in this embodiment, the necessary developer amount is 270 g, so that the developer in the amount of 30 g more than that in the conventional screw constitution is maintained in the developer feeding chamber 401. As a result, it was possible to suppress the image defect generated by no supply of the developer to the developing sleeve 6.

Embodiment 2

A basic constitution of an image forming apparatus in this embodiment is the same as that in Embodiment 1 and therefore will be omitted from description. A different constitution is a constitution of a portion, of the developer feeding member (feeding screw 3*a*) in the developer feeding chamber 401, located at the position opposing the developer carrying region 501 of the developing sleeve 6.

<Characteristic Constitution in this Embodiment>

Also in this embodiment, as the first and second developer feeding members 3*a* and 3*b*, the feeding screw including a rotation shaft 31 substantially in parallel to the axis of the developing sleeve 6 and a stirring blade 32 formed on the outer peripheral surface of the rotation shaft 31 and helically wound in the developer feeding direction is used. With respect to the first feeding screw 32*a* in the developer feeding chamber 4-1, the following constitution is employed. That is, in the developer circulation path described above, as shown in FIG. 9, the helical stirring blade 32 is characterized in that a helical pitch P2 at a position opposing the region 501 in which the developing sleeve 6 has the developer carrying powder is shorter than the helical pitch P1 at a portion other than the position.

By rotation of the first feeding screw 3*a*, the developer in the developer feeding chamber 401 is fed in a downstream side in the developer feeding direction, but in the case where the number of rotations of the feeding screw is the same, a feeding distance of the developer is changed depending on the helical pitch of the stirring blade 32. As in this embodiment, in the region (in which the helical pitch is P2) where the helical pitch is partly shorten, the feeding amount of the developer in the developer feeding direction becomes small relative to that in another region (in which the helical pitch is P1). At a characteristic portion in this embodiment, as shown in FIG. 9, the helical pitch is shorter than that at another portion shown in (b) of FIG. 8 (P2<P1).

As a result, in the developer feeding chamber 401, the developer in the region opposing the developer carrying region 501 of the developing sleeve 6 is increased in amount relative to that in another region, so that the developer in the developer feeding chamber 401 can be stably maintained. The distribution of the developer is the same as that shown in FIG. 5 in Embodiment 1.

By the constitution in this embodiment, the developer surface in the developer feeding chamber 401 is raised, so that an amount of the developer necessary to effect the image formation is decreased. Specifically, in the case of the conventional screw constitution ((b) of FIG. 8), the necessary developer amount is 300 g, but in the constitution in this embodiment, the necessary developer amount is 270 g, so that the developer in the amount of 30 g more than that in the conventional screw constitution is maintained in the developing container 2. As a result, it was possible to suppress the image defect generated by no supply of the developer to the developing sleeve 6.

Embodiment 3

A basic constitution of an image forming apparatus in this embodiment is the same as that in Embodiment 1 and therefore will be omitted from description. A different constitution is such that the rib member 601 provided in Embodiment 1 is gradually increased in size with a position closer to a downstream portion of the developer feeding chamber 401. As shown in FIG. 10, with the position closer to the downstream portion, a width of the rib member 601 is gradually increased (W1<W2<W3).

That is, in the above-described developer circulation path, the developer feeding amount by the first feeding screw 3*a* is set as follows. The developer feeding amount per unit time and unit volume of the developer in the developer circulation direction by the first feeding screw 3*a* at the position opposing the region 501 where the developing sleeve 6 has the developer carrying power is set so as to be gradually decreased with the position closer to a downstream end of the developer feeding direction.

<Characteristic Constitution in this Embodiment>

When the rib member 601 is the same in size between the upstream and downstream sides, at the portion where the rib member 601 is provided, a developer feeding function with respect to the developer feeding direction is the same. With the position closer to the downstream portion of the developer feeding chamber 401, the developer is supplied to the developing sleeve 6 in the larger amount and therefore the developer surface is gradually lowered. When compared with the tendency of the developer surface in the conventional screw constitution, a distribution of the developer surface is improved but its tendency is the same. Accordingly, in the case of the same rib constitution, when the developer in the developing container 2 is decreased, the developer is insufficient at the downstream portion of the developer feeding chamber 401. That is, the necessary developer amount can be further decreased unless the developer is insufficient at the downstream portion of the developer feeding chamber 401.

Figure 6:
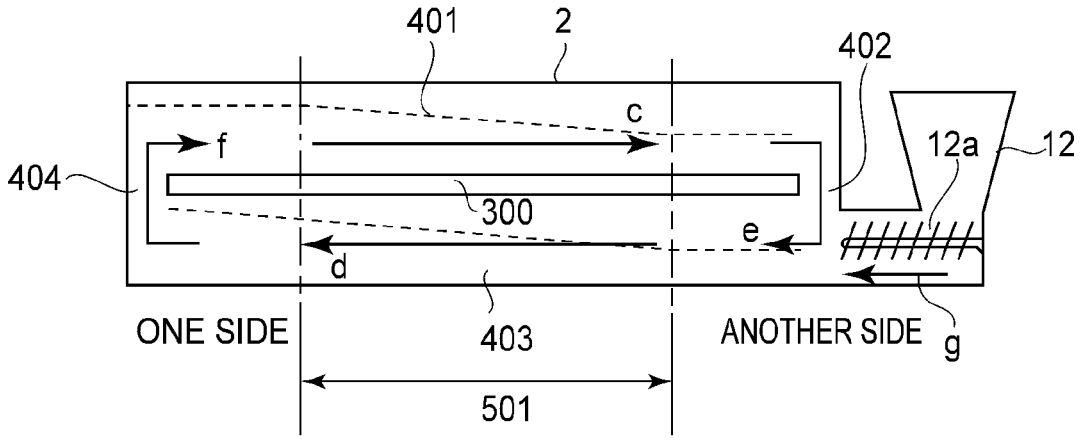

The result is schematically illustrated as shown in FIG. 6, so that a distribution of the developer surface (broken line) in the upstream and downstream sides in the developer feeding chamber 401 is further improved compared with the case of FIG. 5.

By the constitution in this embodiment, a pushing amount of the developer in the direction perpendicular to the feeding direction by the rib member 601 is gradually increased with the position closer to the downstream portion, so that the developer feeding amount in the developer feeding direction is gradually lowered.

Accordingly, the developer surface in the downstream side of the developer feeding chamber 401 is raised, so that an amount of the developer necessary to effect the image formation is decreased. Specifically, in the case of the same rib constitution ((a) of FIG. 8), the necessary developer amount is 270 g, but in the constitution in this embodiment, the necessary developer amount is 250 g, so that the developer in the amount of 20 g more than that in the same rib constitution is maintained in the developing container 2. For that reason, it is possible to suppress the image defect generated by no supply of the developer to the developer carrying member 6.

Embodiment 4

A basic constitution of an image forming apparatus in this embodiment is the same as that in Embodiment 1 and therefore will be omitted from description. Further, in this embodiment, as the first feeding screw 3*a*, any one of those in Embodiments 1 to 3 or a combination of those in Embodiments 1 to 3 is used. A different constitution is such that a cross-sectional area in the downstream side of the developer feeding chamber 401 is reduced. Other constitutions are the same as those in Embodiment 1.

That is, in the above-described developer circulation path, the cross-sectional area perpendicular to the developer feeding direction of the developer feeding chamber 401 at the position opposing the region where the developing sleeve 6 has the developer carrying power is not less than those at other portions.

<Characteristic Constitution in this Embodiment>

In this embodiment, with respect to the direction perpendicular to the developer feeding direction in the developer feeding chamber 401, at the position opposing the developer carrying region 501, compared with its downstream portion, the developer feeding amount in the feeding direction is small. Accordingly, in the downstream side of the position opposing the developer carrying region 501, the developer surface is lower than that in the opposing region and therefore the cross-sectional area can be reduced. Further, in this embodiment, in a space where the ceiling of the developer feeding chamber 401 is lowered in the downstream side, a developer supplying device (not shown) for supplying the developer to the developing device is provided, so that the space is effectively used.

Figure 7:
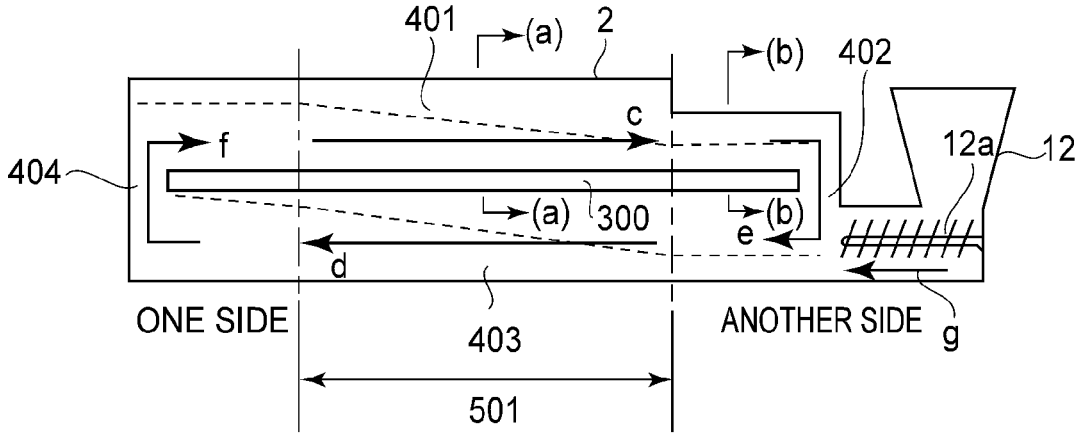
FIG. 7 is a longitudinal sectional view of a developing device in Embodiment 4 to which the present invention is applied.

FIG. 7 is a schematic illustration of the developing device in this embodiment. Part (a) of FIG. 11 is a schematic sectional view of the developer feeding chamber 401 taken along (a)-(a) line indicated in FIG. 7 (sectional view perpendicular to the developer feeding direction at a central portion of the developer feeding chamber 401), and (b) of FIG. 11 is a schematic sectional view of the developer feeding chamber 401 taken along (b)-(b) line indicated in FIG. 7 (sectional view perpendicular to the developer feeding direction in the downstream side of the developer feeding chamber 401).

In this embodiment, with respect to the direction perpendicular to the developer feeding direction in the developer feeding chamber 401, a lower cross section of the developer feeding chamber 401 at the position opposing the developer carrying member 6 and an upstream portion of the opposing position is configured as follows. The lower cross section is a semicircle having a radius larger than a radius of the stirring blade (screw blade) 32 of the first feeding screw 3*a* by 1 mm as a clearance. An upper cross section of the developer feeding chamber 401 is a square having an edge which is 2 mm larger than the diameter of the screw blade 32. The center of the screw shaft 31 is aligned with the center of the semicircle. In the downstream side of the developer stirring chamber 401, the cross section is a circle having a radius which is 1 mm larger than the radius of the screw blade 32. The center of the screw shaft 31 is aligned with the center of the cross section.

By this constitution, it is possible to reduce the volume of the developing container 2 in the region downstream of the position opposing the developer carrying region 501 while maintaining the developer amount in the developer feeding chamber 401 at the position opposing the developer carrying region 501.

Embodiment 5

With respect to the helical stirring blade 32 of the first feeding screw 3*a*, in the above-described developer circulation path, the blade diameter at the position opposing the region 501 where the developing sleeve 6 has the developer carrying power is made smaller than the blade diameter at a portion other than the opposing position. That is, as shown in (a) and (b) of FIG. 12, a blade diameter R32a of the stirring blade 32 at the position opposing the region 501 where the developing sleeve 6 has the developer carrying power is made smaller than a blade diameter R32b of the stirring blade 32 at the portion other than the opposing position.

Also by the constitution of the first feeding screw 3*a* as described above, a functional effect similar to those in the means constitutions in Embodiments 1 to 4 can be obtained. That is, in the developer feeding chamber 401, the developer feeding amount per unit time and unit volume in the developer feeding direction by the first feeding screw 3*a* at the position opposing the region 501 where the developing sleeve 6 has the developer carrying power can be made smaller than that at the portion other than the opposing position. For that reason, it is possible to suppress the image defect caused by no supply of the developer to the developer carrying member 6.

Embodiment 6

With respect to the rotation shaft 31 of the first feeding screw 3*a*, in the above-described developer circulation path, the thickness (diameter) at the position opposing the region 501 where the developing sleeve 6 has the developer carrying power is made thicker than the thickness at a portion other than the opposing position. That is, as shown in (a) and (b) of FIG. 13, a thickness R31a of the rotation shaft 31 at the position opposing the region 501 where the developing sleeve 6 has the developer carrying power is made smaller than a thickness R31b of the rotation shaft 31 at the portion other than the opposing position. Incidentally, the outer diameter of the helical blade is the same in (a) and (b) of FIG. 13.

Also by the constitution of the first feeding screw 3*a* as described above, a functional effect similar to those in the means constitutions in Embodiments 1 to 5 can be obtained. That is, in the above-described developer circulation path, the developer feeding amount by the first feeding screw 3*a* can be set as follows. In the developer feeding chamber 401, the developer feeding amount per unit time and unit volume in the developer feeding direction by the first feeding screw 3*a* at the position opposing the region 501 where the developing sleeve 6 has the developer carrying power can be made smaller than that at the portion other than the opposing position. Thus, it is possible to suppress the image defect caused by no supply of the developer to the developer carrying member 6.

Other Embodiments (1) It is also possible to carry out the present invention by appropriately combining the means constitutions in Embodiments 1 to 6.

(2) The constitution of the image forming apparatus to which the developing device of the present invention is applicable is not limited to the image forming apparatus described in Embodiment 1 but can also be applied to various image forming apparatuses, developing devices and developers. Specifically, the positional relation between the developer feeding chamber and the developer stirring chamber (vertical arrangement, horizontal (left-right) arrangement or the like), the shapes of the developer feeding member and the developer carrying member, the types of the toner and the carrier, and the like are not limited to those in Embodiments 1 to 4.

(3) The image bearing member on which the latent image is to be formed is not limited to the photosensitive member in the electrophotographic image forming process, but may also be a dielectric member in an electrostatic recording image forming process, a magnetic member in a magnetic recording image forming process, a member for forming a resistance pattern-like latent image, and the like member.

(4) The type of the image forming apparatus is not limited to the transfer type. The image forming apparatus may also be a direct transfer type in which photosensitive paper or electrostatic recording paper is used as the image bearing member. The image forming apparatus may also be an image displaying apparatus for forming a toner image on an image displaying member as the image bearing member.

While the invention has been described with reference to the structures disclosed herein, it is not confined to the details set forth and this application is intended to cover such modifications or changes as may come within the purpose of the improvements or the scope of the following claims.

INDUSTRIAL APPLICABILITY

In the developing device including the developing container having the constitution in which the developer feeding function and the developer collecting function is independent of each other, it is possible to suppress the necessary developer amount while maintaining the developer amount in the first developer accommodating chamber as the developer feeding functional portion. As a result, the generation of the image defect such that the part of the image is lost because the amount of the developer in the developer feeding chamber as the first developer accommodating chamber is insufficient and thus cannot be supplied onto the developer carrying member, is suppressed.

The invention claimed is:

1. A developing device comprising:

a developer bearing member for bearing a developer comprising a non-magnetic toner and a magnetic carrier to develop an electrostatic latent image;

a first chamber in which the developer is supplied to the developer bearing member through a first opening provided at a position opposing the developer bearing member;

a second chamber in which the developer is directly collected from the developer bearing member through a second opening provided at a position opposing the developer bearing member without passing through the first chamber;

a partition wall for partitioning the first chamber and the second chamber;

a first communicating portion capable of feeding the developer from the second chamber to the first chamber;

a second communicating portion capable of feeding the developer from the first chamber to the second chamber;

a first screw portion, including a rotation shaft provided rotatably in the first chamber, for feeding the developer in the first chamber; and a second screw portion, including a rotation shaft provided rotatably in the second chamber, for feeding the developer in the second chamber in a direction opposite from a developer feeding direction of the first screw portion, wherein the first screw portion includes a plurality of spiral blades helically wound on an outer peripheral surface of the rotation shaft in the developer feeding direction, and ribs provided in respective positions between adjacent spiral blades, said ribs projecting from the rotation shaft of the first screw portion in a radial direction over an entire opposing region of the first screw portion opposing a developer bearing region of the developer bearing member, with the opposing region not opposed to the first communicating portion or the second communicating portion, wherein in the opposing region, a size of a developer feeding surface of a downstream-most rib with respect to the developer feeding direction of the first screw portion is larger than a size of a developer feeding surface of an upstream-most rib.

2. A developing device according to claim 1, wherein in the opposing region, a developer feeding amount per unit time in the developer feeding direction of the first feeding screw stepwisely decreases from the upstream-most side toward the downstream-most side in the developer feeding direction of the first screw portion.

3. A developing device according to claim 1, wherein no ribs are formed between adjacent spiral blades in a non-opposing region of the first screw portion not opposing the developer bearing region of the developer bearing member, with the non-opposing region not opposed to the first communicating portion or the second communicating portion.

4. A developing device according to claim 3, wherein a blade diameter of the spiral blades in the opposing region is shorter than a blade diameter of the spiral blades in the non-opposing region.

5. A developing device according to claim 3, wherein a thickness of the rotation shaft of the first screw portion in the opposing region is greater than a thickness of the rotation shaft of the first screw portion in the non-opposing region.

6. A developing device according to claim 3, wherein a cross-sectional area, perpendicular to the developer feeding direction in the first chamber, in the opposing region is larger than a cross-sectional area, perpendicular to the developer feeding direction in the first chamber, in the non-opposing region.

7. A developing device according to claim 1, wherein in the opposing region, sizes of developer feeding surfaces of the ribs stepwisely increase from the upstream-most side toward the downstream-most side in the developer feeding direction of the first screw portion.

8. A developing device according to claim 3, wherein a helical pitch of the spiral blades in the opposing region is shorter than a helical pitch of the spiral blades in the non-opposed region.

* * * * *